US006640063B2

(12) United States Patent
Adachi et al.

(10) Patent No.: US 6,640,063 B2
(45) Date of Patent: Oct. 28, 2003

(54) IMAGE FORMING APPARATUS FEATURING FIRST AND SECOND PEAK-TO-PEAK CHARGING VOLTAGES, RESPECTIVELY, CORRESPONDING TO FIRST AND SECOND IMAGE BEARING MEMBER SPEEDS AND VOLTAGE FREQUENCIES

(75) Inventors: Motoki Adachi, Shizuoka (JP); Yasunari Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/015,579

(22) Filed: Dec. 17, 2001

(65) Prior Publication Data

US 2002/0102108 A1 Aug. 1, 2002

(30) Foreign Application Priority Data

Dec. 19, 2000 (JP) ..... 2000-385136

(51) Int. Cl.[7] ..... G03G 15/02
(52) U.S. Cl. ..... 399/50; 399/176
(58) Field of Search ..... 399/50, 174, 176

(56) References Cited

U.S. PATENT DOCUMENTS 5,420,671 A * 5/1995 Kisu et al. ..... 399/50 X
5,450,180 A * 9/1995 Ohzeki et al. ..... 399/50
5,499,080 A * 3/1996 Furuya et al. ..... 399/50
5,636,009 A * 6/1997 Honda et al. ..... 399/50
5,689,770 A * 11/1997 Kurokawa et al. ..... 399/176 X
5,689,777 A * 11/1997 Yamamoto et al. ..... 399/50 X
5,701,551 A * 12/1997 Honda et al. ..... 399/50
5,717,979 A * 2/1998 Senba, deceased et al. ... 399/50
5,792,533 A * 8/1998 Kurokawa et al. ..... 399/176 X
5,842,081 A * 11/1998 Kaname et al. ..... 399/50
5,845,172 A * 12/1998 Saito et al. ..... 399/50
5,991,557 A * 11/1999 Kunishi et al. ..... 399/50 X
6,360,065 B1 * 3/2002 Ishibashi et al. ..... 399/174

FOREIGN PATENT DOCUMENTS

| | | | |
|---|---|---|---|
| JP | 63-149668 | * | 6/1988 |
| JP | 63-149669 | * | 6/1988 |
| JP | 3-100674 | * | 4/1991 |
| JP | 3-156476 | * | 7/1991 |
| JP | 11-288148 | * | 10/1999 |
| JP | 2000-11819 | | 1/2000 |
| JP | 2000-11820 | | 1/2000 |
| JP | 2000-235299 | * | 8/2000 |
| JP | 2000-305342 | * | 11/2000 |

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an image bearing member and a charging member in proximity or in contact with the image bearing member. A frequency of an oscillating voltage is a first frequency when a peripheral speed of the image bearing member is a first peripheral speed, and the frequency of the oscillating voltage is a second frequency when the peripheral speed of the image bearing member is a second peripheral speed. A determining device determines a first peak-to-peak voltage of the oscillating voltage corresponding to the first peripheral speed and the first frequency and a second peak-to-peak voltage of the oscillating voltage corresponding to the second peripheral speed and the second frequency, based on first, second and third alternating currents flowing in the charging member in use of the first peripheral speed and the first frequency. The determined peak-to-peak voltages are applied to the charging member.

9 Claims, 8 Drawing Sheets

IMAGE FORMING APPARATUS FEATURING FIRST AND SECOND PEAK-TO-PEAK CHARGING VOLTAGES, RESPECTIVELY, CORRESPONDING TO FIRST AND SECOND IMAGE BEARING MEMBER SPEEDS AND VOLTAGE FREQUENCIES

BACKGROUND OF THE INVENTION

1. Field of the Invention

The present invention relates to image forming apparatus such as printers, copying machines, facsimile machines, and so on.

More particularly, the invention relates to improvement in image forming apparatus of the indirect (transfer) method or the direct method permitting variation in process speed for formation of image and variation in pixel density for formation of image, in which a desired image is formed and supported on an image bearing member such as an electrophotographic, photosensitive member, an electrostatic recording dielectric member, or the like by suitable image-forming process devices of the electrophotographic method, the electrostatic recording method, or the like.

2. Description of the Related Art

Conventionally, for example, as a method of charging the surface of the image bearing member as a body to be charged, such as the photosensitive member, the dielectric member, or the like in the image forming apparatus such as the electrophotographic apparatus, the electrostatic recording apparatus, and so on, it was common practice to employ the corona charging method being a non-contact charging method, in which a high voltage was applied to a thin corona discharge wire to generate a corona and in which the corona was made to act on the surface of the image bearing member to charge it.

In recent years, a contact charging method of keeping a charging member of a roller type, a blade type, or the like in contact with the surface of the image bearing member as a body to be charged and applying a voltage to the charging member to charge the surface of the image bearing member is going mainstream for reasons of low voltage processes, small ozone evolving amounts, low cost, and so on. Particularly, the charging member of the roller type is able to implement stable charging over long periods of time.

Here the charging member does not always have to be in contact with the surface of the image bearing member being the body to be charged, but the charging member may be placed in no contact with and in proximity to the image bearing member (proximity charging), for example, with a clearance (gap) of several ten $\mu$m as long as a dischargeable area determined by a gap voltage and a corrected Paschen curve is ensured between the charging member and the image bearing member. In the present invention such proximity charging cases are also considered to be within the category of contact charging.

The voltage applied to the charging member may consist of only a dc voltage, but it is also possible to apply an oscillating voltage to the charging member to induce alternate, positive and negative discharges, thereby effecting even charging.

For example, it is known that when the oscillating voltage is applied in the form of superposition of a dc voltage (dc offset bias) and an ac voltage having a peak-to-peak voltage value not less than two times a discharge start threshold voltage (discharge start voltage or charging start voltage) of the charged object upon application of the dc voltage, the effect of averaging the charging of the charged body is achieved, so as to implement even charging.

The waveform of the oscillating voltage does not always have to be limited to only a sine wave, but may also be either of rectangular, triangular, and pulse waves. The oscillating voltage also embraces a voltage of the rectangular wave obtained by periodically switching the dc voltage on and off, and an output obtained by periodically changing values of the dc voltage so as to be equal to the superimposed voltage of the ac voltage and the dc voltage.

The contact charging method of charging the charging member by applying the oscillating voltage thereto as described above, will be referred to hereinafter as "AC charging method." The contact charging method of charging the charging member by applying only the dc voltage thereto will be referred to hereinafter as "DC charging method."

In the AC charging method, however, discharge amounts to the image bearing member (hereinafter referred to as a photosensitive drum) become larger than in the DC charging method. This was the cause of promoting deterioration of the photosensitive drum, e.g., shaving of the photosensitive drum or the like, and there were cases where an abnormal image such as image flow or the like was formed under a high temperature and high humidity environment because of discharge products.

In order to overcome this issue, it is necessary to minimize the alternate, positive and negative discharges, by applying the necessary and minimum voltage.

However, the relation between a voltage and a discharge amount is not always constant in practice, but varies depending upon the film thickness of the photosensitive drum, environmental variation of the charging member and/or air, and so on. Materials become dry under a low temperature and low humidity environment (L/L) to increase their resistances and resist discharge, so that the peak-to-peak voltage not less than a certain value becomes necessary for achievement of even charging. Even at the lowest voltage value to achieve even charging under the L/L environment, if the charging operation is carried out under the high temperature and high humidity environment (H/H), the materials will absorb moisture to decrease the resistances on the contrary and the charging member will cause more discharge than necessary. This will result in an increase in discharge amounts, which will pose problems of occurrence of image flow and blur, occurrence of toner fusion, shaving and life decrease of the photosensitive drum due to deterioration of the surface of the photosensitive drum, and so on.

In order to restrain this increase/decrease of discharge due to the environmental variation, the "AC constant current control method" of controlling the current value of an alternating current flowing upon application of the ac voltage to the charging member was also proposed, in addition to the "AC constant voltage control method" of always applying the fixed ac voltage as described above. According to this AC constant current control method, the peak-to-peak voltage value of the ac voltage can be increased under the low temperature and low humidity environment (L/L) where the resistances of the materials increase, whereas the peak-to-peak voltage value can be decreased under the high temperature and high humidity environment (H/H) where the resistances of the materials decrease. Therefore, it becomes feasible to restrain the increase/decrease of discharge, as compared with the AC constant voltage control method.

For aiming to further increase the life of the photosensitive drum, however, the AC constant current control method cannot be mentioned as perfect in order to suppress the increase/decrease of discharge amount due to variation of resistances caused by production dispersion and contamination of the charging member, capacitance variation of the photosensitive drum after long-term use, dispersion of high-voltage devices in the main body, and so on. In order to suppress this increase/decrease of discharge amount, it is necessary to employ means for decreasing the production variation of the charging member and the environmental variation and for canceling fluctuation of high voltage, which will increase the cost.

For stably providing high image quality and high quality over long periods of time, it is thus necessary to control the voltage and current applied so as not to cause over discharge and so as to implement even charging without a problem. As a method for realizing it, the inventors accomplished the invention of "discharge current amount control method" (Japanese Patent Applications No. 2000-11819 and No. 2000-11820), which is such a method that, where Vth stands for a discharge start voltage to the image bearing member upon application of the dc voltage to the charging member, during a non-image-forming period current values are measured upon application of at least one peak-to-peak voltage less than two times Vth and upon application of at least two peak-to-peak voltages not less than two times Vth and that a peak-to-peak voltage value of the ac voltage necessary for obtaining a desired discharge current amount to be applied to the charging means during an image-forming period is determined from the relation between the peak-to-peak voltages of the ac voltage and the alternating current values thus measured.

Since this method was configured to actually measure the relation between peak-to-peak voltages of the charging AC voltage and AC values and determine the peak-to-peak voltage value necessary for obtaining the desired discharge current amount, it became feasible to absorb the environmental variation, the production dispersion of the charging member, and so on.

This method is effective, especially, in the image forming apparatus of the cleanerless type without a cleaner such as a blade or the like used for cleaning up the region on the photosensitive drum by removing toner and others thereon. This is because the cleanup effect on the photosensitive drum is not expected in such apparatus, the condition is thus more severe for the image flow under H/H, and residual toner after transfer is not removed and will cause fog at the position of development due to charging failure at positions of transfer residual toner on the photosensitive drum unless an adequate discharge amount is given during execution of the charging process. In the image forming apparatus of the cleanerless type, as described above, it was necessary to control the discharge amount with higher accuracy, for using the ac voltage as the charging voltage.

In recent years, the image forming apparatus such as the printers and others are required to meet the necessity and resolution (pixel density) for printing on a variety of media such as thick sheets, OHP sheets, etc. with expanding diversity of user's print needs, and it is met by providing a single apparatus with a plurality of process speeds (print speeds).

There arose, however, the following problems where the image forming apparatus using the contact charging apparatus for applying the oscillating voltage was adapted for a plurality of process speeds.

A) The first problem is interference fringes called "moire patterns", which appear when the frequency of the oscillating voltage (which will be referred to hereinafter as charging frequency) applied to the contact charging apparatus interferes with the spatial frequency of line pitch of line scanning.

A conceivable method for preventing this phenomenon is, for example, such countermeasures that the charging frequency fp is set sufficiently larger than the spatial frequency fs, but this method is not preferable because of the detrimental phenomenon of charging sound increasing with increase of the frequency, and others.

B) The second problem is periodical "uneven development," which occurs when the frequency of the oscillating voltage applied to the charging member is close to an integral multiple or an integral submultiple of a frequency of an oscillating voltage applied to a developing sleeve.

This uneven development occurs when the frequency of the oscillating voltage applied to the charging member is around a frequency equal to an integral multiple or an integral submultiple of the frequency of the oscillating voltage applied to the developing sleeve. Since this is basically unevenness of surface potential on the photosensitive drum, discrimination of unevenness becomes easier in print of images with higher resolution. Therefore, the frequency range of occurrence of unevenness tended to become wider.

Particularly, in the case wherein the charging means and developing means are integrated into a process cartridge detachable from the main body of the image forming apparatus, electric paths for supplying the development bias voltage to the developing sleeve might be placed near electric paths for supplying the charging bias voltage to the charging roller from the structural aspect of contacts with the main body of the image forming apparatus. These paths could interfere with each other through a floating capacitance to produce beat components in the respective bias voltages, which can result in formation of an abnormal image similar to the uneven image described above.

C) The third problem is that if the charging frequency is fixed against change of the process speed the number of discharges in each unit surface of the photosensitive drum increases at a low process speed to promote the image flow and blur and the deterioration and shaving of the photosensitive drum under high humidity conditions while the number of discharges decreases at a high process speed on the contrary to fail to effect sufficient charging, posing the problems of uneven charging and charging failure.

This problem can be overcome by changing the charging frequency at a rate equal to a rate of the change of the process speed.

In order to solve the above problems, it was necessary to change the charging frequency against change of the process speed.

It becomes feasible to provide high-quality images in the process-speed-variable image forming apparatus, by combining the change of the charging frequency with the "discharge current amount control method".

However, if the "discharge current amount control method" is applied with a change of the charging frequency against a change of the process speed as described above, the alternating current value will become smaller with a decrease of the frequency even at the same peak-to-peak voltage value of the oscillating voltage, whereas the alternating current will flow more with an increase of the frequency on the other hand. For this reason, the range of alternating current values measured becomes wider, which will increase the cost because of electronic parts used for accurate measurement in the wide range or which will degrade the measurement accuracy in measurement at low cost.

If "discharge current amount controls" are carried out at respective process speeds, the time will become longer for operations other than the print operation and this will result in degradation of usability.

SUMMARY OF THE INVENTION

An object of the present invention is to provide an image forming apparatus capable of optimizing the discharge current of the charging member.

Another object of the present invention is to provide an image forming apparatus that implements highly accurate, uniform, and satisfactory charging over long periods of time without increasing the cost, even in the case of images being formed at a plurality of process speeds.

Still another object of the present invention is to provide an image forming apparatus that can enhance the usability by decreasing the operation time for control.

Still another object of the present invention is to provide an image forming apparatus in which interference fringes are prevented from occurring.

Further objects and features of the present invention will become more apparent by reading the following detailed description with reference to the accompanying drawings.

DETAILED DESCRIPTION OF THE PREFERRED EMBODIMENTS

Embodiment 1 (FIG. 1 to FIG. 8)

Figure 1:
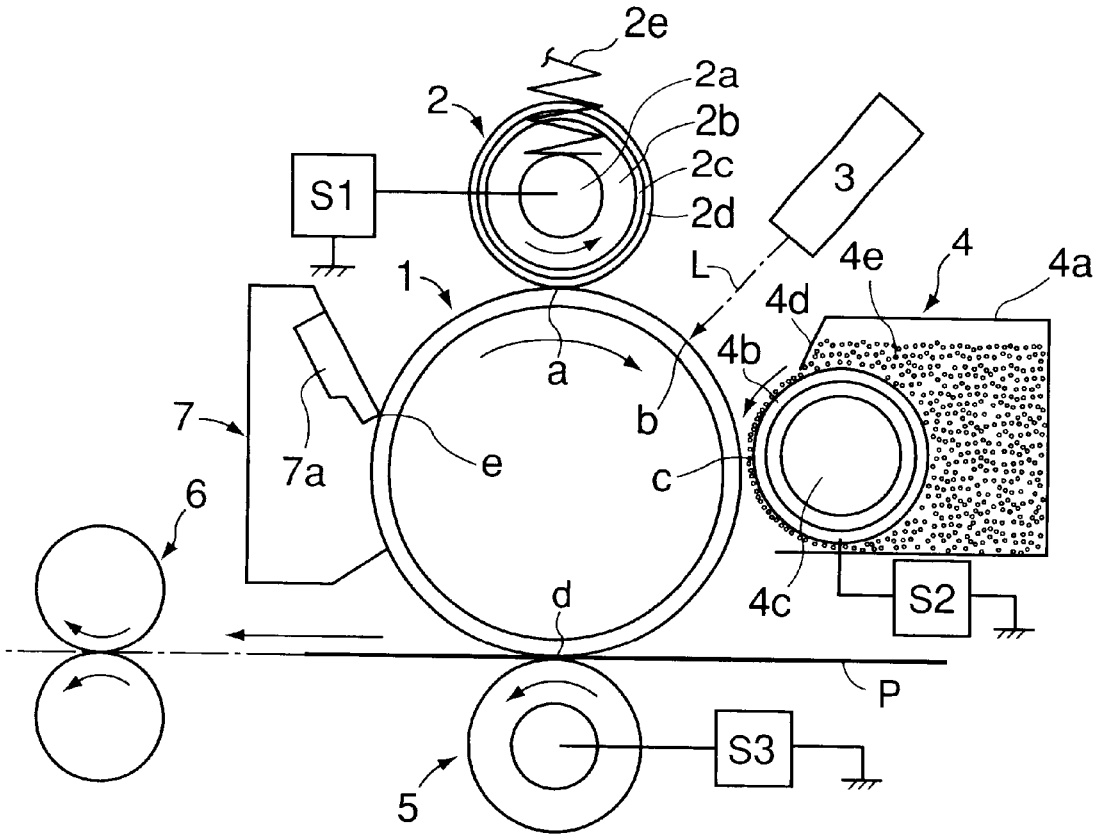
FIG. 1 is a schematic view to show the schematic structure of an image forming apparatus in Embodiment 1.

FIG. 1 is a schematic view to show the schematic structure of an example of the image forming apparatus according to the present invention. The image forming apparatus of the present embodiment is a laser beam printer that is of a type utilizing the transfer type electrophotographic process, the contact charging method, and the reversal developing method and that permits change in the process speed for formation of image and change in the pixel density for formation of image.

(1) Overall Schematic Structure of the Printer a) Image Bearing Member

Numeral 1 denotes an electrophotographic, photosensitive member of a rotary drum type (hereinafter referred to as a photosensitive drum) as an image bearing member. This photosensitive drum 1 is an organic photoconductor (OPC) with a negative charging property and has the outside diameter of 25 mm. The photosensitive drum 1 is normally rotated clockwise, as indicated by an arrow, at the process speed (peripheral speed) of 100 mm/sec around the center axis during formation of image.

Figure 2:
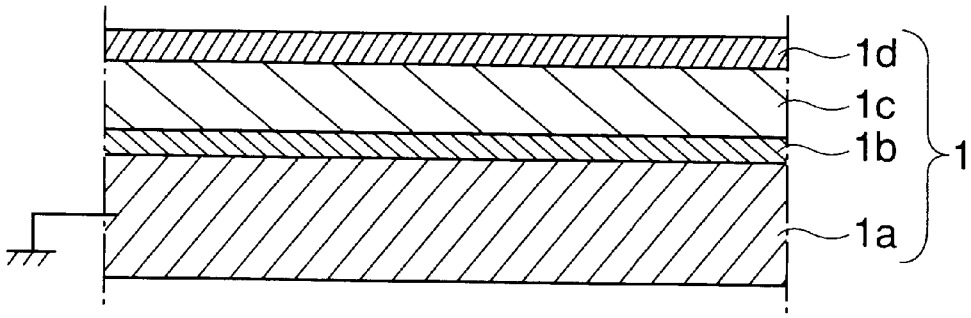
FIG. 2 is a schematic view to show the layer structure of the photosensitive member.

This photosensitive drum 1, as shown in the schematic view of the layer structure of FIG. 2, is constructed in structure in which three layers, an underlying layer 1*b* for suppressing interference of light and enhancing adhesion of an upper layer, a photocharge generating layer 1*c*, and a charge transport layer 1*d* (t $\mu$m thick), are laid in order from bottom over a surface of an aluminum cylinder (electroconductive drum base) 1*a*.

b) Charging Means

Numeral 2 designates a contact charging device (contact charger) as a charging means for uniformly charging the peripheral surface of the photosensitive drum 1, which is a charging roller (roller charger) in the present embodiment.

This charging roller 2 is rotatably held by unrepresented bearing members at two ends of a core (supporting member) 2*a* and is urged against the photosensitive drum by pressure spring 2*e* so as to be pressed under a predetermined pressure against the surface of the photosensitive drum 1. Therefore, the charging roller 2 rotates in accordance with the rotation of the photosensitive drum 1. The press contact part between the photosensitive drum 1 and the charging roller 2 is a charging portion (charging nip portion) a.

A power supply S1 applies a charging bias voltage under a predetermined condition to the core 2*a* of the charging roller 2 whereby the peripheral surface of the rotary, photosensitive drum 1 is uniformly contact-charged in the negative polarity in the case of the present embodiment.

The structure of the aforementioned charging roller 2, the discharge current control, etc. will be detailed in section (4).

c) Information Writing Means

Numeral 3 designates an exposing apparatus as an information writing means for forming an electrostatic, latent image on the surface of the charged photosensitive drum 1, which is a laser beam scanner using a semiconductor laser in the present embodiment. The exposing apparatus 3 outputs laser light modulated according to an image signal sent from a host device such as an unrepresented image reading device or the like to the printer side and implements laser scanning exposure L (image scanning exposure) at the exposure position b on the uniformly charged surface of the rotary, photosensitive drum 1. This laser scanning exposure L lowers potentials at irradiated positions with the laser light on the surface of the photosensitive drum 1 whereby an electrostatic, latent image corresponding to the image information under scanning exposure is successively formed on the surface of the rotary, photosensitive drum 1.

d) Developing Means

Numeral 4 denotes a jumping developing apparatus (developing unit) in the case of the present embodiment as a developing means for supplying a developer (toner) onto the electrostatic, latent image on the photosensitive drum 1 to visualize the electrostatic, latent image. The electrostatic, latent image formed on the surface of the photosensitive drum 1 is reversal-developed with one-component magnetic toner (negative toner) negatively charged by the developing apparatus 4.

Symbol 4*a* designates a developer container and 4*b* a nonmagnetic developing sleeve. The developing sleeve 4*b* is rotatably placed in the developer container 4*a* while exposing part of the outer peripheral surface to the outside. Symbol 4*c* denotes a magnet roller inserted in the developing sleeve 4*b* as fixed so as not to rotate. Numeral 4*d* represents a developer coating blade, 4*e* one-component magnetic toner as a developer stored in the developer container 4*a,* and S2 a power source for applying a development bias to the developing sleeve 4*b*.

Therefore, the surface of the developing sleeve 4*b* rotating counterclockwise as indicated by an arrow is coated with the developer as a thin layer, and the one-component magnetic toner conveyed to the developing portion c is selectively transferred corresponding to the electrostatic, latent image onto the surface of the photosensitive drum 1 by an electric field established by the development bias whereby the electrostatic, latent image is developed into a toner image. In the case of the present embodiment, the toner attaches to bright portions of exposure on the surface of the photosensitive drum 1 to effect the reversal development of the electrostatic, latent image.

The thin developer layer on the developing sleeve 4*b* passing the developing portion c is returned to the developer reservoir portion in the developer container 4*a* with successive rotation of the developing sleeve.

e) Transferring Means, Fixing Means, and Cleaning Means

Numeral 5 represents a transferring apparatus, which is a transferring roller in the present embodiment. This transferring roller 5 is pressed under a predetermined pressure against the photosensitive drum 1, and the press nip portion is a transferring portion d. A transferring material (recording medium or recording material) P is fed at a predetermined control timing from an unrepresented sheet feeding mechanism to this transferring portion d.

The transferring material P fed to the transferring portion d is conveyed as nipped between the photosensitive drum 1 and the transferring roller 5 under rotation, and during that period, a transfer bias with the positive polarity, which is opposite to the negative polarity being the regular charging polarity of the toner, is applied from a power source S3 to the transferring roller 5 whereby the toner image on the surface of the photosensitive drum 1 is successively electrostatically transferred onto the surface of the transferring material P as being nipped and conveyed through the transferring portion d.

The transferring material P, onto which the toner image was transferred through the transferring portion d, is successively separated from the surface of the rotary, photosensitive drum 1 to be conveyed to a fixing apparatus 6 (e.g., a thermal roller fixing apparatus; a fixing device) where the toner image is subjected to fixing processing and outputted as an image product (a print or copy).

Numeral 7 denotes a cleaning apparatus, in which the surface of the photosensitive drum 1 after the transfer of the toner image onto the transferring material P is scraped and cleaned by a cleaning blade 7*a* so as to remove the transfer residual toner. Thereafter, the photosensitive drum is repeatedly subjected to formation of an image. Symbol e represents a contact portion of the cleaning blade 7*a* with the surface of the photosensitive drum.

(2) Operation Sequence of the Printer

Figure 3:
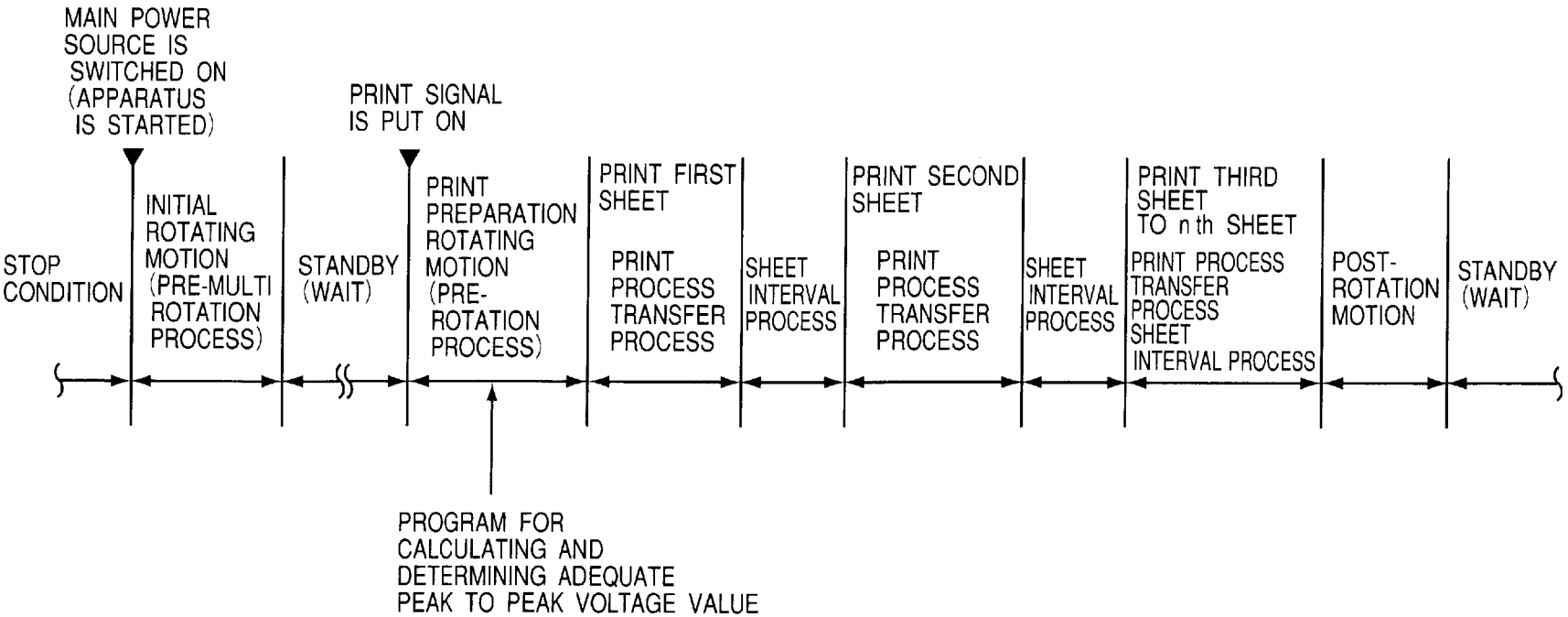
FIG. 3 is a diagram to show the operation sequence of the image forming apparatus.

FIG. 3 is a diagram to show the operation sequence of the above-stated printer.

a. Initial Rotating Motion (Pre-multirotation Process)

The period of the initial rotating motion is a start operation period (activation operation period or warming period) during activation of the printer. When the power switch is turned on, preparation operations of predetermined process devices are executed to rotate the photosensitive drum, heat the fixing apparatus to a predetermined temperature, and so on.

b. Print Preparation Rotating Motion (Pre-rotation Process)

The period of the print preparation rotating motion is a preparatory rotating motion period before formation of an image between on of a print signal and actual execution of the image forming (print) process operation, and the print preparation rotating motion is executed subsequent to the initial rotating motion, with input of the print signal during the initial rotating motion. Without input of the print signal, the driving of the main motor is once stopped after completion of the initial rotating motion to stop the rotational drive of the photosensitive drum whereby the printer is kept in a standby (wait) state until input of the print signal. Once the print signal is fed, the print preparation rotating motion is executed.

In the present embodiment, executed in this print preparation rotating motion period is a program for calculating and determining an adequate peak-to-peak voltage value (or alternating current value) of the ac voltage applied in the charging step of the printing process. This will be detailed later in section (4), part C).

c. Print Process (Image Forming Step or Imaging Step)

After completion of the predetermined print preparation rotating motion, the imaging process over the rotary, photosensitive drum is subsequently carried out, followed by the transferring process of the toner image formed on the surface of the rotary, photosensitive drum, onto the transferring material and by the fixing process of the toner image by the fixing apparatus to print the image product out.

In the case of a continuous printing (consecutive print) mode, the aforementioned print process is repeatedly carried out by a preset print number n.

d. Sheet Interval Process

In the continuous printing mode, each sheet interval process is a non-passage period of a recording sheet at the transferring position between passage of a trailing end of one transferring material through the transferring position d and arrival of a leading end of a next transferring material at the transferring position d.

e. Post-rotation Motion

A period of post-rotation motion is a period for carrying out a predetermined post-motion to rotate the photosensitive drum by continuing the drive of the main motor for a while even after completion of the print process of the last transferring material.

f. Standby

After completion of the predetermined post-rotation motion, the drive of the main motor is stopped to terminate the rotational drive of the photosensitive drum whereby the printer is kept in the standby state before input of the next print start signal.

In the case of only one print, the printer is brought through the post-rotation motion into the standby state after completion of the print.

When a print start signal is entered in the standby state, the printer moves into the pre-rotation process.

The periods of the print process c correspond to periods of image formation, while the periods of the initial rotation motion a, the print preparation rotating motion b, the sheet intervals d, and the post-rotation motion e to periods of non-image formation.

(3) Change of Process Speed

The image forming apparatus of the present embodiment is media-flexible and is ready for a variety of media including plain paper and special sheets such as thick sheets, OHP sheets, and so on. However, the toner is resistant to fixing on the thick sheets, OHP sheets, etc. because of their large heat capacity, and if it is fixed at the normal process speed there will arise problems of unfixed images, poor permeability of the OHP sheets, and so on.

Therefore, the toner image is fixed by a method of decreasing the speed during passage of the transferring material P of the recording medium through the fixing apparatus 6 to fix the toner image in a sufficient press and heat time. It is, however, difficult to keep the speed low only at the fixing apparatus 6 because of increase of cost and structural issues, and, therefore, the fixing is implemented by a method of decreasing the process speed of the entire apparatus.

In fact, the apparatus of the present embodiment is provided with a normal mode adapted for plain paper and with half speed and quarter speed modes adapted for the thick sheets and OHP sheets, and the process speed is changed from the normal process speed of 100 mm/sec to either of process speeds of 50 mm/sec and 25 mm/sec.

The process speed is also changed when a high resolution mode to print an image in high resolution is selected. In the high resolution mode, the process speed is reduced to half of the speed in the normal mode whereby the resolution in the main scanning direction can be doubled from the normal resolution, thereby implementing the high resolution.

For changing the process speed (mode) as described above, an operator can designate either mode on a control panel of a host computer or the main body of the apparatus, for example.

(4) Detailed Description of Charging Means

A) Charging Roller 2

The charging roller 2 as a contact charging member has the longitudinal length of 320 mm and has the three-layer structure in which the lower layer 2*b,* the intermediate layer 2*c,* and the surface layer 2*d* are successively laid from bottom around the core 2*a,* as shown in the schematic view of the layer structure of FIG. 1. The lower layer 2*b* is a foamed sponge layer for reducing the charging sound, the intermediate layer 2*c* an electroconductive layer for attaining uniform resistance as a whole of the charging roller, and the surface layer 2*d* a protective layer provided for preventing a leak from occurring even with defects of pinholes and others on the photosensitive drum 1.

More specifically, the specifications of the charging roller 2 of the present embodiment are as follows.

Core 2*a;* round bar of stainless steel having the diameter of 6 mm

Lower layer 2*b;* foamed EPDM with carbon dispersed, having the specific gravity of 0.5 g/cm$^3$, the volume resistivity of $10^5$ Ωcm, the layer thickness of 3.0 mm, and the length of 320 mm Intermediate layer 2*c;* NBR base rubber with carbon dispersed, having the volume resistivity of $10^5$ Ωcm and the layer thickness of 700 μm Surface layer 2*d;* Toresin resin of a fluorine compound with tin oxide and carbon dispersed, having the volume resistivity of $10^8$ Ωcm, the surface roughness (10-point mean surface roughness Ra according to JIS standards) of 1.5 μm, and the layer thickness of 10 μm During the normal print the power source S1 applies a predetermined oscillating voltage in which an ac voltage with the frequency of 1000 Hz is superimposed on a dc voltage, through the core 2*a* to the charging roller 2 whereby the peripheral surface of the photosensitive drum 1 under rotation is charged to a predetermined potential. When the process speed is changed to the half speed or to the quarter speed, the charging frequency is also changed to 500 Hz or 250 Hz being a half or a quarter of the normal frequency of 1000 Hz. If the charging were implemented at the charging frequency fixed in spite of the change of the process speed to half, the number of discharges would be double that during normal image formation in each unit area on the photosensitive drum, so as to result in the problems of deterioration of the photosensitive drum, increase of shaving of the drum, and so on. In addition, there is a possibility of occurrence of moire patterns.

B) Charging Bias Applying System

Figure 4:
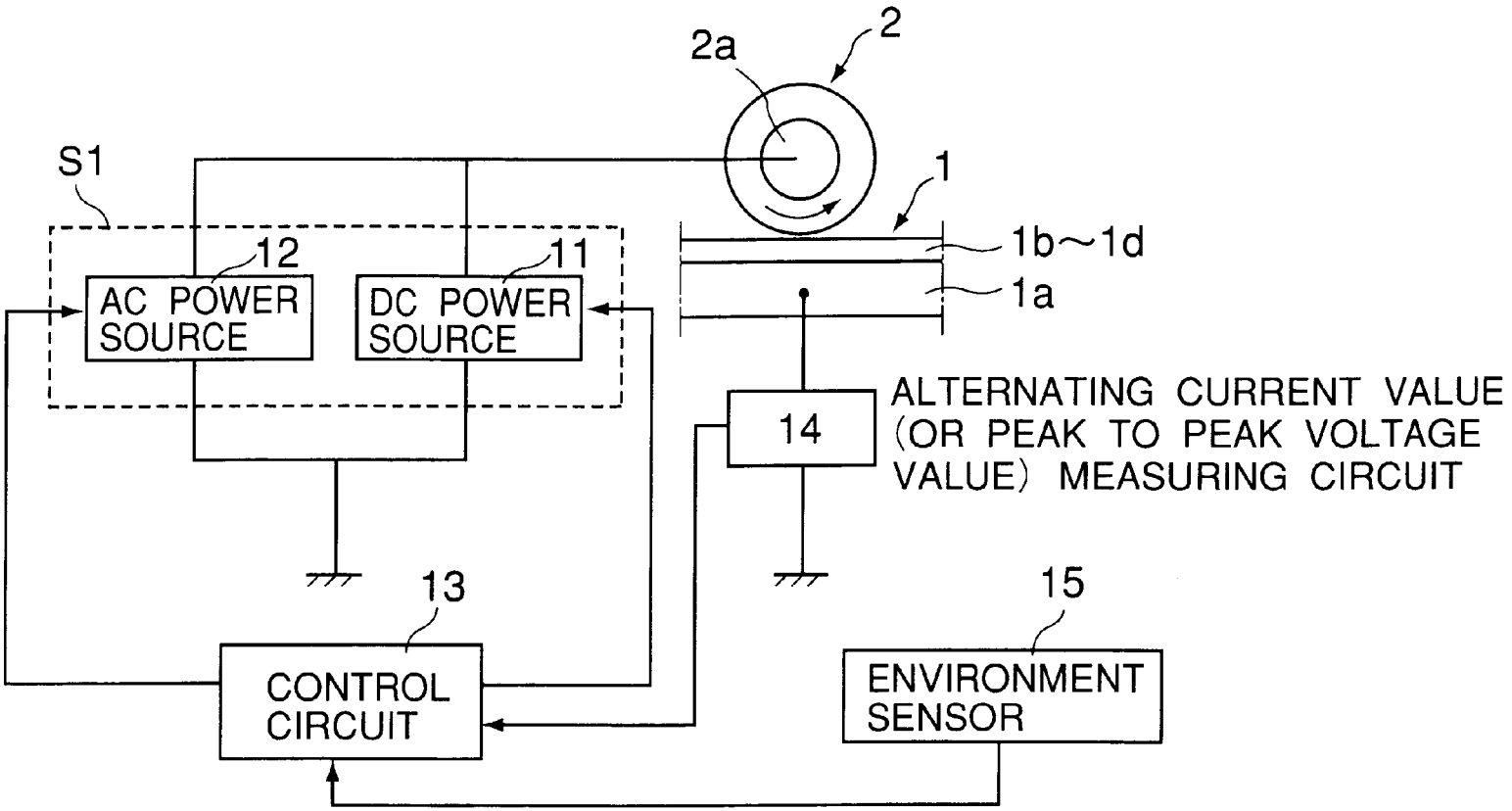
FIG. 4 is a block circuit diagram of a charging bias applying system.

FIG. 4 is a block circuit diagram of a charging bias applying system to the charging roller 2.

The power source S1 applies the predetermined oscillating voltage (bias voltage Vdc+Vac) in which the ac voltage of the frequency f is superimposed on the dc voltage, through the core 2*a* to the charging roller 2 whereby the peripheral surface of the photosensitive drum 1 rotating is charged to the predetermined potential.

The power source S1 of voltage applying means to the charging roller 2 has a direct current (DC) power source 11 and an alternating current (AC) power source 12.

Numeral 13 represents a control circuit, which has a function of controlling the power source so as to apply either of the dc voltage and the ac voltage, or the superimposed voltage thereof to the charging roller 2 by controlling on/off of the DC power source 11 and the AC power source 12 of the power source S1, and a function of controlling the value of the dc voltage applied from the DC power source 11 to the charging roller 2 and the peak-to-peak voltage value of the ac voltage applied from the AC power source 12 to the charging roller 2.

Numeral 14 indicates an alternating current value measuring circuit as a means for measuring the value of the alternating current flowing through the photosensitive body 1 to the charging roller 2 (detecting means). This circuit 14 feeds information about the measured alternating current value to the foregoing control circuit 13.

Numeral 15 designates an environment sensor (thermometer and hygrometer) as a means for detecting an environment in which the printer is installed. This environment sensor 15 feeds information about the environment detected, to the foregoing control circuit 13.

Then the control circuit 13 has a function of executing the program of calculating and determining the adequate peak-to-peak voltage value of the applied ac voltage to the charging roller 2 in the charging process of the print process from the input alternating current value information fed from the alternating current value measuring circuit 14 and the input environment information fed from the environment sensor 15.

C) Discharge Current Control

Described below is a method of controlling the peak-to-peak voltage value of the ac voltage applied to the charging roller 2 during print.

The inventors discovered from various studies that the discharge current amount expressed in numerical form by the definition below substitutively indicated the actual AC discharge amount and had a strong correlation with the shaving of the photosensitive drum, the image flow, and the charging uniformity.

Figure 5:
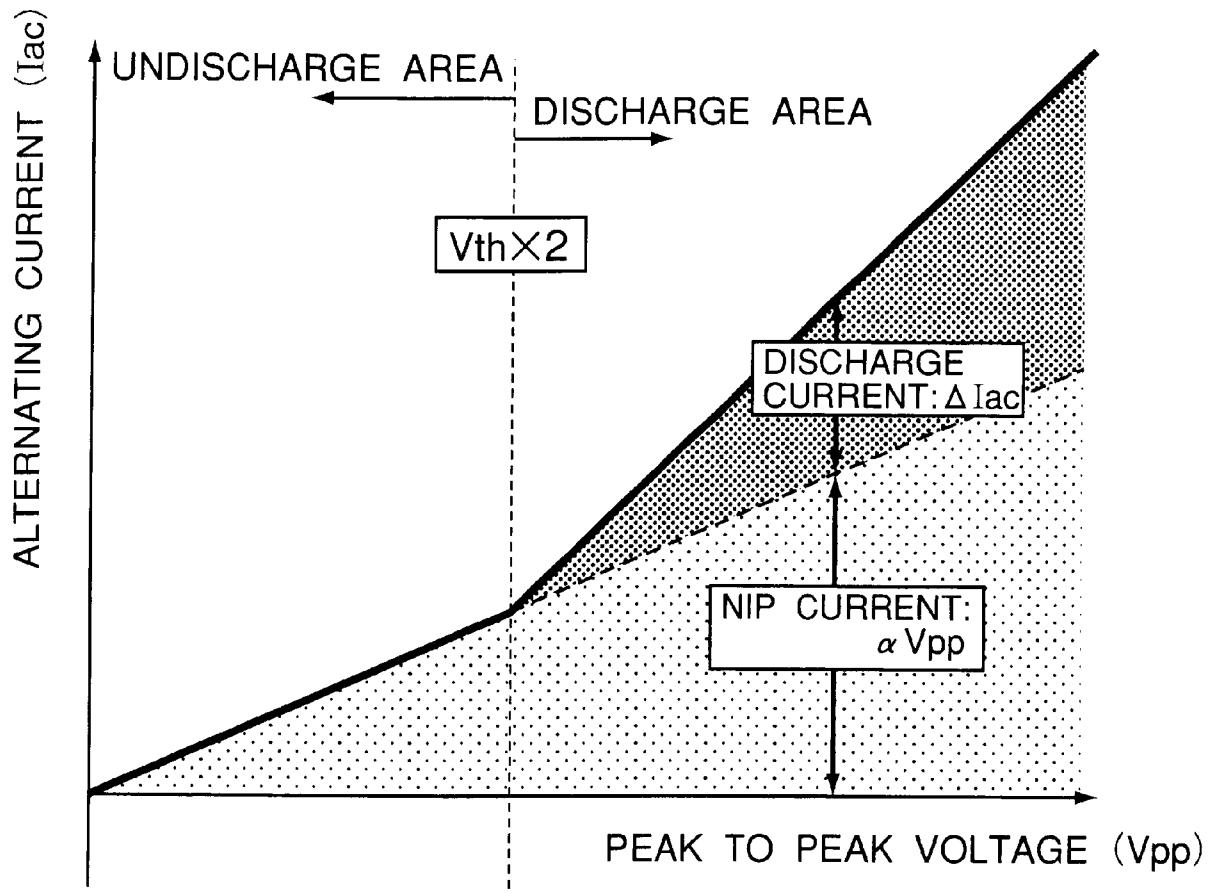
FIG. 5 is a schematic diagram of measurement of discharge current amounts.

As shown in FIG. 5, the alternating current Iac is in the linear relation with the peak-to-peak voltage Vpp in the range below the charging start voltage (discharge start voltage) Vth×2 (V) (or in the undischarge area), and the current deviates so as to increase gradually as the voltage becomes not less than the charging start voltage and enters the discharge area. This increase is considered to be an increment ΔIac of the current associated with the discharge, because the linearity was maintained in similar experiment in vacuum where no discharge occurred.

The charging start voltage Vth is a minimum applying dc voltage value at which charging of the body to be charged starts as the dc voltage applied to the charging member is increased.

Letting α be a ratio of the current Iac to the peak-to-peak voltage Vpp less than the charging start voltage Vth×2 (V), the alternating current including the nip current and the like except for the current resulting from discharge is given as α·Vpp. Then the difference ΔIac between this α·Vpp and Iac measured during application of the voltage not less than the charging start voltage Vth×2 (V) is defined blow as the discharge current amount substitutively indicating the amount of discharge.

$$\Delta Iac = Iac - \alpha \cdot Vpp \quad \text{Eq. 1}$$

This discharge current amount varies depending upon the environment and advance of endurance where charging is implemented under control at a fixed voltage or a fixed current. This is because the relation between peak-to-peak voltage and discharge current amount and the relation between alternating current value and discharge current amount vary.

In the AC constant current control method, the control is done so that the total current flowing from the charging member to the body to be charged becomes constant. This total current amount is the sum of the current flowing to the contact portion (hereinafter referred to as nip current: α·Vpp) and the current flowing because of discharge at the non-contact portion (hereinafter referred to as discharge current amount: ΔIac), as described above, and in the constant current control the control of current is conducted in the form including the nip current, as well as the discharge current being the current necessary for actually charging the body to be charged.

For this reason, the discharge current amount is not controlled in fact even if the total current is controlled. Even if the total current is controlled at an equal current value in the constant current control, environmental variation of the material of the charging member will naturally decrease the discharge current amount with increase of the nip current or increase the discharge current amount with decrease of the nip current. It is thus impossible to restrain the increase/decrease of the discharge current amount perfectly even by the AC constant current control method, and it was difficult to meet the both needs for suppression of the shaving of the photosensitive drum and for the charging uniformity, for aiming at the long life.

Then the inventors employed the control according to the following procedure in order to always attain the desired discharge current amount.

Let D be the desired discharge current amount, and let us explain a method of determining the peak-to-peak voltage substantiating this discharge current amount D.

In the present embodiment, during the print preparation rotation motion the control circuit 13 is made to execute the program of calculating and determining the adequate peak-to-peak voltage value of the applying ac voltage to the charging roller 2 in the charging process during the print process.

Specifically, this will be described with reference to the Vpp-Iac graph of FIG. 6 and the control flowchart of FIG. 7.

Figure 6:
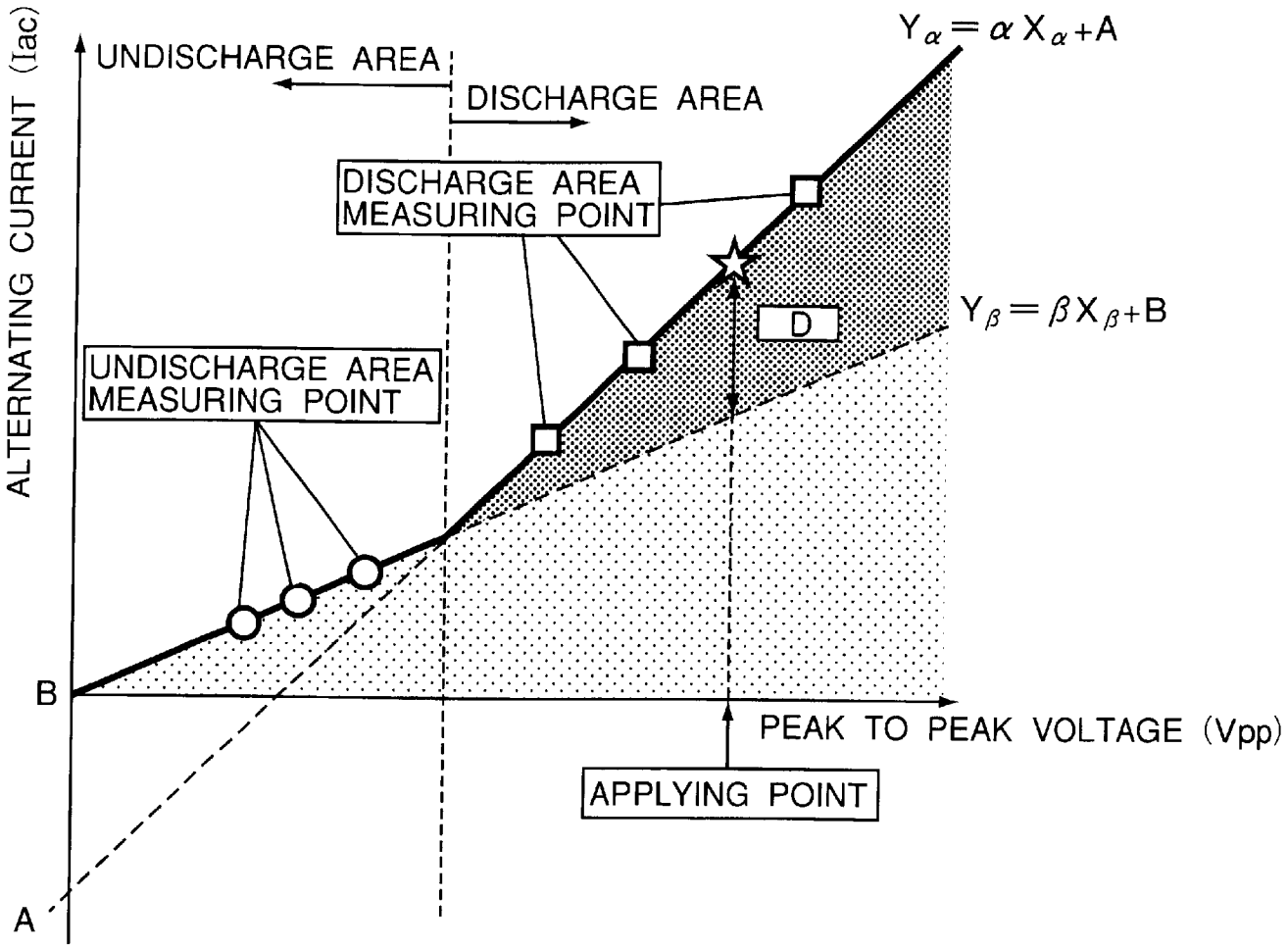
FIG. 6 is a diagram to show a relation between peak-to-peak voltage and alternating current measured during print preparation rotation.
Figure 7:
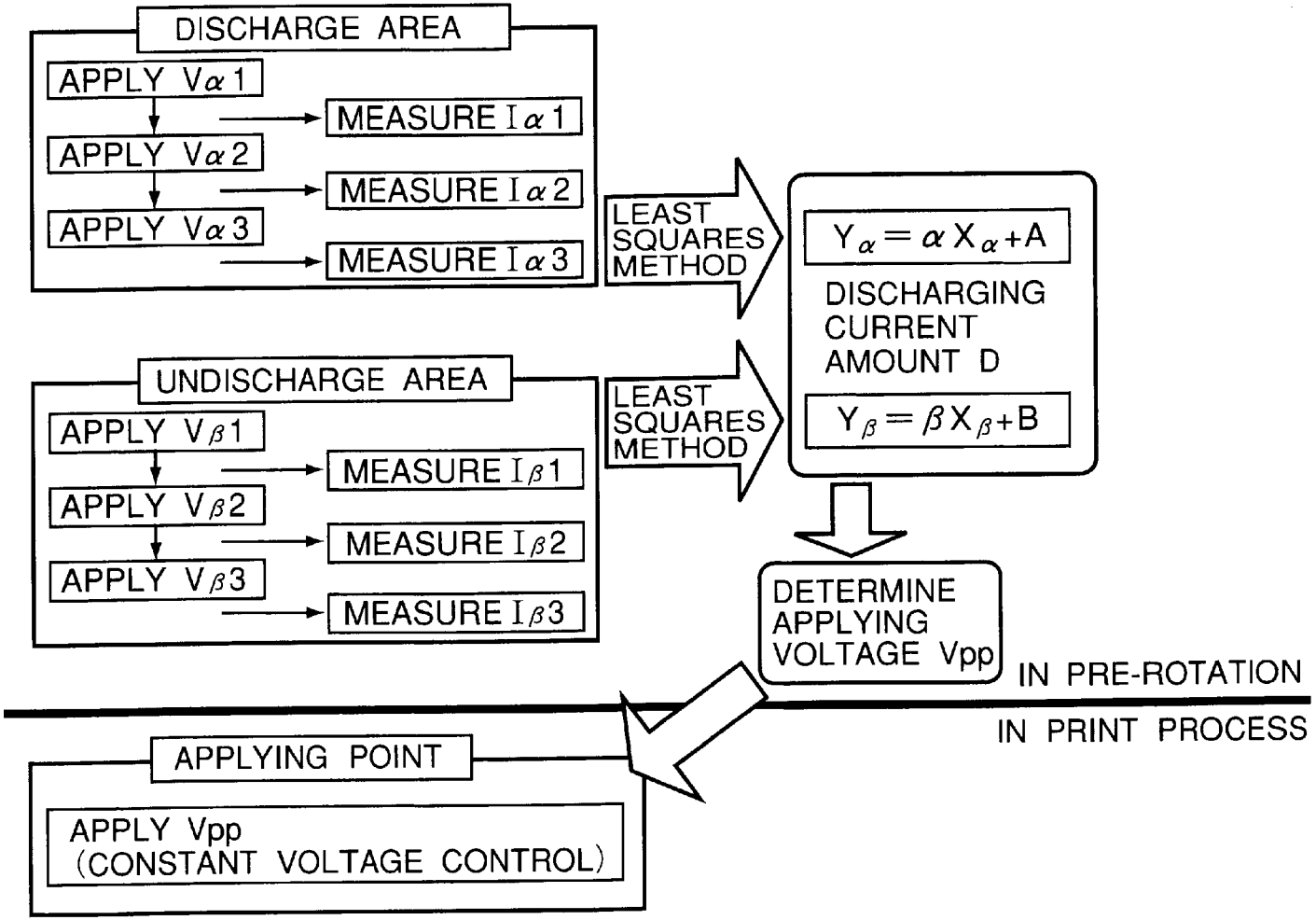
FIG. 7 is a flowchart of control of charging.

During the print preparation rotation motion, i.e., during the period in which the charging member is located corresponding to an area becoming a non-image area of the photosensitive member, the control circuit 13 controls the AC power source 12 so as to successively apply three peak-to-peak voltages (Vpp) at three points within the discharge area and three peak-to-peak voltages at three points within the undischarge area to the charging roller 2, as shown in FIG. 6, and the alternating current value measuring circuit 14 measures values of alternating current flowing through the photosensitive member 1 to the charging roller 2 at the respective points and feeds the measured values to the control circuit 13.

Then the control circuit 13 performs linear approximation of relations between peak-to-peak voltage and alternating current for the discharge and undischarge areas by the least squares method, using the current values measured at the three points for each area, to obtain Eq. 2 and Eq. 3 below.

a straight line approximated for the discharge area:

$$Y_\alpha = \alpha X_\alpha + A \quad \text{Eq. 2}$$

a straight line approximated for the undischarge area:

$$Y_\beta = \beta X_\beta + B \quad \text{Eq. 3}$$

If the slope of the approximate straight line for the undischarge area is known, Eq. 3 can be obtained by detecting the current at at least one point in the undischarge area. If the relation between peak-to-peak voltage and alternating current in the discharge area is approximately a straight line, Eq. 2 can be obtained by detecting the current at at least two points in the discharge area.

After that, the peak-to-peak voltage Vpp where the aforementioned difference between the approximate line for the discharge area of Eq. 2 and the approximate line for the undischarge area of Eq. 3 becomes the predetermined discharge current amount D, is determined according to Eq. 4 below.

$$Vpp = (D - A + B)/(\alpha - \beta) \quad \text{Eq. 4}$$

Then the peak-to-peak voltage applied to the charging roller 2 is switched to Vpp obtained by above Eq. 4, and the constant voltage control is carried out in the print process, i.e., during the period in which the charging member is located corresponding to an area becoming an image area of the photosensitive member.

In this way, the apparatus is configured to calculate the peak-to-peak voltage necessary for obtaining the predetermined discharge current amount for print, during every print preparation rotation and apply the obtained peak-to-peak voltage during print by the constant voltage control, whereby it becomes feasible to attain the desired discharge current amount securely while absorbing the fluctuation of resistance due to the production dispersion of the charging roller 2 and/or the environmental variation of the material, and the high-voltage dispersion of the apparatus of the main body.

Figure 8:
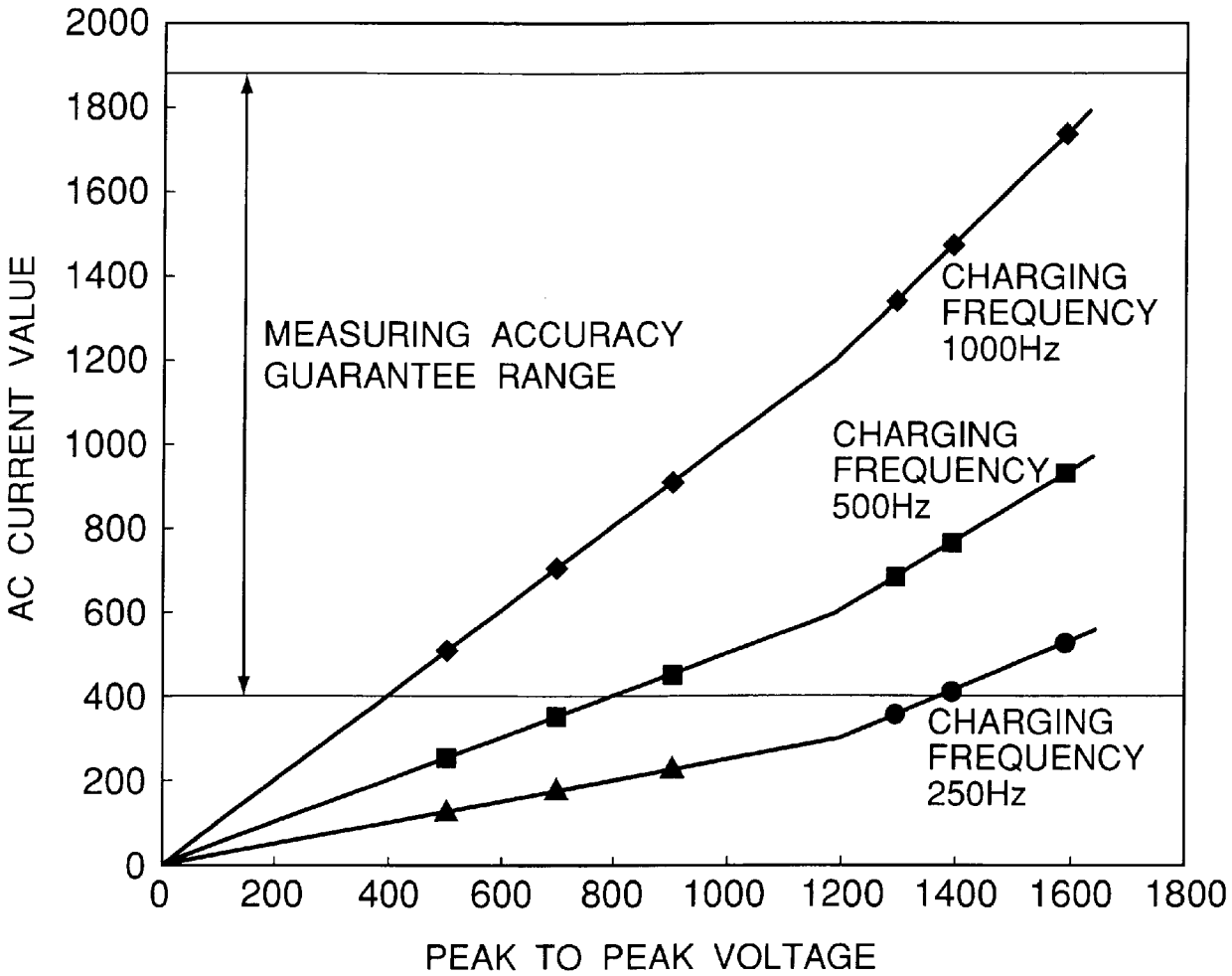
FIG. 8 is a diagram to show charging frequency characteristics of the relation between peak-to-peak voltage and alternating current.

The inventors enabled achievement of stable charging as described above, but found that, when the above discharge current amount control was carried out at the frequency equal to 50% or 25% of the frequency used during the normal image formation in the half speed or quarter speed mode of the process speed, alternating current amounts measured were too small and outside the measuring accuracy guarantee range, as shown in FIG. 8, to degrade the accuracy and thus there occurred dispersion of peak-to-peak voltage applied, so as to fail to achieve stable charging. A considerable cost increase was expected for maintaining the high accuracy in the wide range.

Therefore, the inventors invented a method of preliminarily determining desired discharge current amounts in the half speed mode and in the quarter speed mode in which the process speed was changed from the normal speed. Namely, this method is a method of measuring the current flowing to the foregoing charging member in the normal process speed and determining the peak-to-peak voltage to be applied to the charging member during print, by the discharge current control. Namely, the motion of measuring the current flowing to the charging member is not carried out in the half speed and quarter speed modes.

When images were formed in the half speed and quarter speed modes under this control, good images were obtained on a stable basis, and in endurance check it was also feasible to implement formation of high-definition images without causing the deterioration and shaving of the photosensitive drum under all environments.

In the present embodiment, the "discharge current amount control (measurement of current)" is carried out using the charging oscillating voltage at the high frequency (1000 Hz) and the peak-to-peak voltage values of the charging oscillating voltage are determined for all the process speeds. This is because the high frequency increases the alternating current values measured and makes it feasible to decrease errors of control. Without having to be limited to this on the contrary, it is, however, also possible to carry out the control using a low frequency within the measuring accuracy guarantee range of alternating current value.

In the present embodiment the discharge current amount is controlled by switching the peak-to-peak voltage of the ac voltage applied to the charging roller, but, without having to be limited to this, it is also possible on the contrary to measure the peak-to-peak voltage values of the ac voltage by applying the alternating current and control the alternating current so as to be able to always apply the alternating current necessary for obtaining the desired discharge current amount during print.

Further, in the present embodiment the peak-to-peak voltage value applied during the print preparation rotation is fixed for all the environments, but in the apparatus provided with the environment sensor, voltage values may be variably determined for the respective environments, which permits execution of more stable uniform charging.

Figure 9:
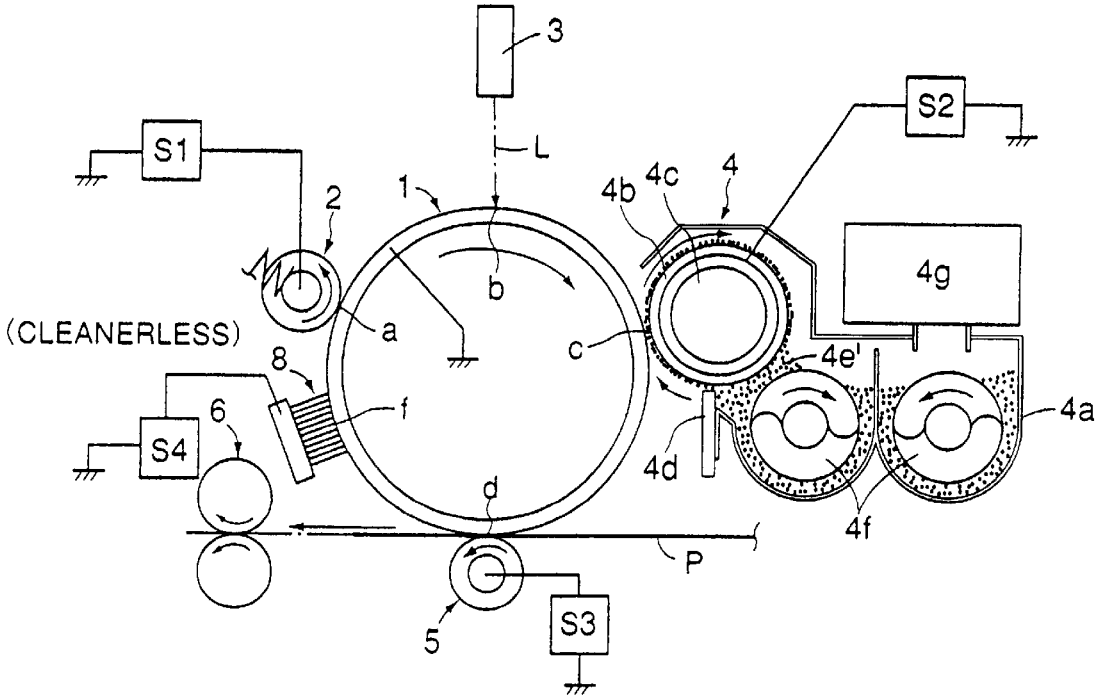
FIG. 9 is a schematic view to show the schematic structure of an image forming apparatus (of the cleanerless type) in Embodiment 2.

Embodiment 2 (FIG. 9)

FIG. 9 is a schematic diagram to show the schematic structure of the image forming apparatus in the present embodiment. The image forming apparatus of the present embodiment is a laser beam printer that utilizes the transfer type electrophotographic process, that is of the contact charging method, the reversal developing method, the cleanerless type, and the maximum passing sheet size of the A3 size, and that permits change in the process speed for formation of image and change in the pixel density for formation of image.

Constitutive components and portions common to those in the printer of foregoing Embodiment 1 will be denoted by the same reference symbols and redundant description will be omitted. The following will describe constitutive components, portions, and items different from the printer of Embodiment 1.

(1) Overall Schematic Structure of the Printer

In the printer of the present embodiment, the photosensitive drum 1 as an image bearing body has the outside diameter of 50 mm. The photosensitive drum 1 is rotated clockwise, as indicated by an arrow, at the process speed (peripheral speed) of 100 mm/sec about the center axis during the normal image formation. However, the printer is provided with the half speed mode and the quarter speed mode for implementing adequate fixing for the thick sheets, OHP sheets, etc., and the process speed is set at 50 mm/sec or 25 mm/sec in the half speed or quarter speed mode.

In the charging process, the voltage under a predetermined condition is applied to the charging roller 2 as a contact charger to implement uniform charging processing in the negative polarity on the surface of the photosensitive drum 1. The frequency of the charging oscillating voltage is 1000 Hz during the formation of image in the normal process speed mode and the frequency is changed to 500 Hz or to 250 Hz when a half or a quarter of the normal speed, respectively, is selected as a process speed.

The developing apparatus 4 being a developing means is a reversal developing device of the two-component magnetic brush development method and this developing apparatus 4 successively reversal-develops the electrostatic, latent image formed on the surface of the photosensitive drum 1, into a toner image, with toner frictionally charged in negative (negative toner) in the case of the present embodiment. The developer 4*e* stored in the developer container 4*a* is a two-component developer. Symbol 4*f* designates developer agitating members located on the bottom side in the developer container 4*a,* and 4*g* a toner hopper for storing replenishment toner.

The two-component developer 4*e*' in the developer container 4*a* is a mixture of the toner and a magnetic carrier and is agitated by the developer agitating members 4*f*. In the present embodiment the mean particle size of the toner is 6 $\mu$m, the resistance of the magnetic carrier about $10^{13}$ $\Omega$cm, and the particle size of the carrier about 40 $\mu$m. The toner is rubbed with the magnetic carrier to be frictionally charged in the negative polarity.

The developing sleeve 4*b* is opposed to the photosensitive drum 1 in proximity thereto with the closest distance (which will be referred to hereinafter as S-Dgap) being kept at 350 $\mu$m to the photosensitive drum 1. This opposed portions of the photosensitive drum 1 and the developing sleeve 4*a* constitute the developing portion c. The developing sleeve 4*b* is rotated in the opposite direction to the moving direction of the photosensitive drum 1 at the developing portion c.

Part of the two-component developer 4*e'* in the developer container 4*a* is attracted and retained as a magnetic brush layer on the outer peripheral surface of the developing sleeve 4*b* by magnetism of the magnet roller 4*c* inside the sleeve. The magnetic brush layer is rotationally conveyed with rotation of the sleeve and is shaped into a predetermined thin layer by a developer coating blade 4*d*. Then the magnetic brush layer goes into contact with the surface of the photosensitive drum 1 at the developing portion c to rub the surface of the photosensitive drum properly. A predetermined development bias is applied from the power source S2 to the developing sleeve 4*b*.

In this manner, the surface of the developing sleeve 4*b* rotating is coated with a thin layer and the toner component in the developer conveyed to the developing portion c is selectively transferred corresponding to the electrostatic, latent image onto the surface of the photosensitive drum 1 by an electric field established by the developing bias, whereby the electrostatic, latent image is developed into a toner image. In the case of the present embodiment the toner attaches to bright portions of exposure on the surface of the photosensitive drum 1 to reversal-develop the electrostatic, latent image.

The thin developer film on the developing sleeve 4*b,* having passed the developing portion c, is returned to the developer reservoir portion in the developer container 4*a* with subsequent rotation of the developing sleeve.

In order to maintain the concentration of the toner of the two-component developer 4*e*' in the developer container 4*a* within a predetermined approximately constant range, the concentration of the toner of the two-component developer 4*e*' in the developer container 4*a* is detected, for example, by an optical toner concentration sensor not shown, and the toner hopper 4*g* is driven and controlled according to the detected information to replenish the two-component developer 4*e*' in the developer container 4*a* with the toner in the toner hopper. The toner replenished into the two-component developer 4*e*' is agitated by the agitating members 4*f*.

(2) Cleanerless System

The printer of the present embodiment is cleanerless and is provided with no dedicated cleaning device for removing the transfer residual toner remaining in a small amount on the surface of the photosensitive drum 1 after the transfer of the toner image onto the transferring material P. The transfer residual toner on the surface of the photosensitive drum 1 after the transfer is conveyed through the charging portion a and the exposing portion b with successive rotation of the photosensitive drum 1 to be brought to the developing portion c, and is subjected to cleaning simultaneously with developing (collected) by the developing apparatus 3.

The cleaning simultaneous with developing is a method of collecting the transfer residual toner on the photosensitive member after the transfer, in the developing process in and after the next process, i.e., collecting the transfer residual toner existing on portions of the photosensitive member surface not to be developed with the toner, into the developing apparatus by a fog eliminating bias (a fog eliminating potential difference Vback being a potential difference between the dc voltage applied to the developing apparatus and the surface potential of the photosensitive member) during the process of the developing step of the electrostatic, latent image after the steps of subsequently charging the photosensitive member and exposing it to form the electrostatic, latent image. According to this method, since the transfer residual toner is collected into the developing apparatus and reused for development of electrostatic, latent images in and after the next process, it is feasible to decrease waste toner and reduce the load of maintenance. The cleanerless structure is also advantageous in compactification of the image forming apparatus.

Numeral 8 designates a toner charging control means, which is located at a position downstream of the transferring portion d in the rotating direction of the photosensitive drum and upstream of the charging portion a in the rotating direction of the photosensitive drum. This toner charging control means 8 is a brush-shaped member (auxiliary brush) with moderate electroconductivity, and the brush part thereof is kept in contact with the surface of the photosensitive drum 1. A negative voltage is applied from a power source S4 to the toner charging control means 8. Symbol f denotes a contact portion between the brush part and the surface of the photosensitive drum 1. The transfer residual toner on the photosensitive drum 1, passing the toner charging control means 8, is controlled so that the charge polarities thereof are aligned in the negative polarity being the regular polarity.

Namely, the transfer residual toner on the surface of the photosensitive drum 1 after the transferring process includes the negative toner that failed to be transferred at image portions, the positive fog toner that attached to non-image portions during development, and the toner whose polarity was reversed to the positive polarity under influence of the positive voltage for transferring. The charge polarities of the transfer residual toner are uniformly aligned into the negative polarity by the foregoing toner charging control means 8. In the present embodiment, the voltage of −1000 V, which is a voltage enough to induce discharge to the photosensitive member after the transfer, is applied to the toner charging control means 8. This provides the transfer residual toner passing the toner charging control means 8, with charge by discharge and direct charge injection to align the polarities into the negative polarity.

In the aforementioned charging process, the region on the surface of the photosensitive drum 1 is charged from above the transfer residual toner. Since the transfer residual toner is uniformly aligned in the negative polarity, no toner attaches to the charging roller 2 to which the dc voltage with the negative polarity is applied. In the exposure process exposure is also made from above the transfer residual toner, but no significant effect appears because of the small amount of the transfer residual toner. In the developing process, the transfer residual toner present on unexposed portions on the photosensitive drum 1 is collected into the developing apparatus in association with the electric field.

The closest distance (S-Dgap) is 350 $\mu$m between the developing sleeve 4*b* and the photosensitive drum 1, as described previously, and by maintaining this distance, the magnetic brush of the two-component developer formed on the developing sleeve 4*b* properly rubs the surface of the photosensitive drum 1 to effect collection simultaneous with development of the transfer residual toner on the photosensitive drum 1. For facilitating the collection of the transfer residual toner, the developing sleeve 4*b* is rotated in the opposite direction to the moving direction of the surface of the photosensitive drum 1 at the developing portion c.

(3) Control of Peak-to-peak Voltage of AC Voltage

In the cleanerless system, the use of the AC charging method raises the following problem. Namely, the problem is the image flow and blur due to discharge products made by AC charging.

In the case of the AC charging method by the contact charging, an evolving ozone amount is small but not null, as compared with the charging processing by the corona charger, so that the discharge products cause the adverse effect more or less. In the image forming apparatus, the discharge products attach to the surface of the photosensitive member as an image bearing member and absorb moisture to decrease the resistance of the surface of the photosensitive member, thereby lowering the resolution of the latent image. In the image forming apparatus employing the cleanerless structure as described above, the cleanup effect of the photosensitive member by the cleaning device cannot be expected, so as to cause the blur, image flow, etc. readily.

In order to meet the needs for solving the above problem and for achieving charging uniformity, it is necessary to always attain the desired discharge current amount, and for that purpose, it is necessary to use the applied voltage controlling means to the charging roller.

In the present embodiment the peak-to-peak voltage control of the ac voltage is carried out as follows.

For every hundred sheets (reduced to A4), ac voltage values are measured by successively applying peak-to-peak voltages at three points in the undischarge area and at three points in the discharge area, to the charging roller and a peak-to-peak voltage to be applied during print is determined based on the measured values. The method of calculating the peak-to-peak voltage applied is similar to the method described in <Embodiment 1>.

Further, the image forming apparatus of the present embodiment is configured to perform the discharge current control at the charging frequency of 1000 Hz as well, on the occasion of changing the charging frequency to 500 Hz or 250 Hz with change of the process speed in the thick sheet or high resolution image output mode, and determine the peak-to-peak voltage applied to the charging roller in the half speed or quarter speed mode, based thereon.

This method allows the relation between the alternating current and the peak-to-peak voltage applied to the charging member to be measured with high accuracy even on the occasion of forming an image in the half speed mode or in the quarter speed mode in the cleanerless apparatus, which is likely to cause the image flow and blur, whereby it becomes feasible to manage the discharge amount severely and to stably form good images over long periods of time without the problems of the image flow and blur, shaving of the drum, fusion, and so on.

In the present embodiment, the discharge current amount D to be controlled is made variable depending upon the process speeds, whereby it becomes feasible to attain the desired discharge current amount more securely.

Further, the environment sensor 15 (FIG. 4) is provided in the main body of the apparatus employed in the present embodiment and the value of the discharge current amount D is variably determined for each of environments. Then the control to decrease the discharge current amount to about two thirds of the discharge current amount D set in the L/L environment is effected in the H/H environment where the discharge current amount necessary for attaining the charging stability is smaller and the image flow is more likely to occur than in the L/L environment.

This solved the aforementioned problems by setting the discharge current amount in the H/H environment to about two thirds of that in the L/L environment, whereby it becomes feasible to securely prevent the occurrence of the image flow and blur in the H/H environment and implement stable uniform charging without occurrence of a sand pattern in the L/L environment.

It is noted herein that the charging member does not always have to be kept in contact with the surface of the image bearing member being the body to be charged and that the charging member may be placed in no contact with and in proximity to the image bearing member (proximity charging), for example, with the clearance (gap) of several ten $\mu$m as long as the dischargeable area determined by the gap voltage and the corrected Paschen curve is assured. In the present invention this proximity charging is also included in the category of the contact charging.

Others

1) In the embodiments only the print operation in monocolor (monochrome) was described, but the present invention is not limited to it and can demonstrate similar effect in full-color print operation as well.

2) In the embodiments the program of calculating and determining the adequate peak-to-peak voltage value or alternating current value of the applied ac voltage in the charging process of the print process is executed in the period of the print preparation rotation motion being the non-image-forming period of the printer, but the execution period of the calculating and determining program is not limited to the period of the print preparation rotation motion as in the printers of the embodiments. On the contrary, the calculating and determining program may also be carried out in another non-image-forming period, i.e., either of the initial rotating motion period, the sheet interval process period, and the post-rotation process period, or may be executed across a plurality of non-image-forming periods.

3) The image bearing member may also be an amorphous silicon photosensitive member in which the surface layer has the volume resistivity of about $10^{13}$ Ω·cm.

4) The flexible contact charging member can also be selected from shapes and materials of fur brush, felt, fabric, etc., in addition to the charging roller. It is also possible to obtain a charging member with more suitable elasticity, electroconductivity, surface nature, and durability by combination of various materials.

5) The waveform of the alternating voltage component (AC component; the voltage with voltage values changing periodically) of the oscillating voltages applied to the contact charging member and to the developing member can be properly selected from the sine wave, rectangular wave, triangular wave, and so on. The alternating voltage may also be a rectangular wave formed by periodically switching a dc power source on and off.

6) The image exposure means as an information writing means for writing information on the charged surface of the photosensitive member as an image bearing member can also be, for example, a digital exposure means using a solid-state light-emitting device array like LEDs, as well as the laser scanning means in the embodiments. The image exposure means may also be an analog image exposure means using a halogen lamp, a fluorescent tube, or the like as an original illuminating light source. The point is that the image exposure means is able to form an electrostatic latent image according to image information.

7) The image bearing member may also be an electrostatic recording dielectric member or the like. In this case, the surface of the dielectric member is uniformly charged and thereafter the charge on the charged surface is selectively eliminated by a charge eliminating means such as a charge-eliminating probe head or an electron gun or the like to write an electrostatic, latent image according to objective image information.

8) The toner developing method and means of the electrostatic, latent image can be determined arbitrarily. The developing method may be either the reversal developing method or the regular developing method.

In general, the developing methods of electrostatic, latent image are roughly classified under four types: a method of coating the developer carrying/conveying member such as the sleeve or the like with toner by the blade or the like in the case of the nonmagnetic toner or by magnetism in the case of the magnetic toner, conveying the toner, and applying the toner in a non-contact state to the image bearing member to develop the electrostatic, latent image (one-component non-contact development); a method of coating the developer carrying/conveying means with toner as described above and applying the toner in a contact state to the image bearing member to develop the electrostatic, latent image (one-component contact development); a method of using the mixture of the magnetic carrier with toner particles as a developer (two-component developer), conveying the toner by magnetism, and applying the toner in the contact state to the image bearing member to develop the electrostatic, latent image (two-component contact development); a method of applying the foregoing two-component developer in the non-contact state to the image bearing member to develop the electrostatic, latent image (two-component non-contact development).

9) The transferring means does not have to be limited to the roller transfer in the embodiments, but can be either of the blade transferring, belt transferring, and other contact transfer charging methods and may also be the non-contact transfer charging method using the corona charger.

10) The present invention can not be applied only to the monochromatic image formation, but can also be applied to image forming apparatus for forming multi-color or full-color images by multiple transfers or the like, through use of an intermediate transfer body such as a transferring drum, a transferring belt, or the like.

11) The image bearing member 1, such as the photosensitive drum or the like, and the image-forming process devices 2, 4, 7, 8, etc. acting thereon can be arbitrarily combined to constitute a process cartridge attachable to and detachable from the main body of the image forming apparatus. The process cartridge is a cartridge in which the image bearing member (photosensitive drum) is integrated with at least one of the charging means, developing means, and cleaning means so as to be attachable to and detachable from the main body of the image forming apparatus.

According to the embodiments, as described above, where the charging frequency is changed according to each of the process speeds, the control is implemented at the single charging frequency on the occasion of determining the value of the peak-to-peak voltage to be applied to the charging member, by the "discharge current control method", whereby it becomes feasible to keep the measured alternating currents within the narrow range, implement the control highly accurately without increase of cost, and maintain the high image quality and high quality on a stable basis without causing the problems of the charging failure, image flow, shaving of the drum, etc. even at a plurality of process speeds.

What is claimed is:

1. An image forming apparatus comprising:

an image bearing member;

a charging member, which is provided in proximity or in contact to said image bearing member and to which an oscillating voltage is applied to charge said image bearing member; and determining means for determining a peak-to-peak voltage of the oscillating voltage applied to said charging member, based on a first alternating current flowing in said charging member under application of at least a first peak-to-peak voltage less than 2 Vth to said charging member and based on second and third alternating currents flowing in said charging member under application of first and second peak-to-peak voltages not less than 2 Vth to said charging member, where Vth represents a discharge start voltage between said charging member and said image bearing member, wherein when a peripheral speed of said image bearing member is a first peripheral speed, a frequency of the oscillating voltage is a first frequency, wherein when the peripheral speed of said image bearing member is a second peripheral speed, the frequency of the oscillating voltage is a second frequency, and wherein said determining means determines a first peak-to-peak voltage of the oscillating voltage corresponding to the first peripheral speed and the first frequency and a second peak-to-peak voltage of the oscillating voltage corresponding to the second peripheral speed and the second frequency, based on the first, second and third alternating currents in use of the first peripheral speed and the first frequency.

2. An image forming apparatus according to claim 1, further comprising detecting means for detecting the first, second and third alternating currents.

3. An image forming apparatus according to claim 2, wherein the first, second and third alternating currents are detected in a non-image-forming period of said image bearing member.

4. An image forming apparatus according to any one of claims 1 to 3, wherein the peak-to-peak voltage determined by said determining means is applied to said charging member in an image-forming period of said image bearing member.

5. An image forming apparatus according to claim 1, wherein the first peripheral speed is greater than the second peripheral speed, the first frequency is greater than the second frequency, the first peripheral speed and the first frequency can be selected in formation of an image on plain paper, and the second peripheral speed and the second frequency can be selected in formation of an image on a special sheet.

6. An image forming apparatus according to claim 1, wherein the first peripheral speed is greater than the second peripheral speed, the first frequency is greater than the second frequency, the first peripheral speed and the first frequency can be selected in formation of an image in a first pixel density, and the second peripheral speed and the second frequency can be selected in formation of an image in a second pixel density greater in density of the image than the first pixel density.

7. An image forming apparatus according to claim 1, wherein the first peripheral speed is greater than the second peripheral speed and the first frequency is greater than the second frequency.

8. An image forming apparatus according to claim 1, further comprising developing means for developing an image formed on said image bearing member, with a developer, wherein said developing means is capable of collecting the developer remaining on said image bearing member.

9. An image forming apparatus according to claim 1, wherein the first and second peak-to-peak voltages determined by said determining means are not less than 2 Vth.

* * * * *

UNITED STATES PATENT AND TRADEMARK OFFICE

CERTIFICATE OF CORRECTION

PATENT NO. : 6,640,063 B2
DATED : October 28, 2003
INVENTOR(S) : Motoki Adachi et al.

It is certified that error appears in the above-identified patent and that said Letters Patent is hereby corrected as shown below:

Column 9,
Line 48, “2a;” should read -- 2a: --;
Line 50, “2b;” should read -- 2b: --;
Line 54, “2c;” should read -- 2c: --; and
Line 57, “2d;” should read -- 2d: --.

Column 18,
Line 66, “can not” should read -- cannot --.

Signed and Sealed this

Twenty-second Day of June, 2004

JON W. DUDAS
*Acting Director of the United States Patent and Trademark Office*